US006103371A

United States Patent [19]

Prickett

[11] Patent Number: 6,103,371

[45] Date of Patent: Aug. 15, 2000

[54] CUT RESISTANT YARN AND FABRIC

[75] Inventor: Larry John Prickett, Richmond, Va.

[73] Assignee: E. I. du Pont de Nemours and Company, Wilmington, Del.

[21] Appl. No.: 08/999,705

[22] Filed: Sep. 29, 1997

Related U.S. Application Data

[63] Continuation of application No. 08/770,190, Dec. 19, 1996.
[60] Provisional application No. 60/009,718, Jan. 5, 1996.

[51] Int. Cl.[7] ..... D02G 3/00

[52] U.S. Cl. ..... 428/359; 428/373; 428/374; 428/401; 442/189; 442/301; 442/308; 442/309

[58] Field of Search ..... 428/359, 373, 428/374, 401; 442/189, 301, 308, 309

[56] References Cited

U.S. PATENT DOCUMENTS

| | | | |
|---|---|---|---|
| 4,384,449 | 5/1983 | Byrnes et al. | 57/210 |
| 4,470,251 | 9/1984 | Bettcher | 57/230 |
| 4,711,079 | 12/1987 | Newton et al. | 57/12 |
| 4,777,789 | 10/1988 | Kolmes et al. | 57/210 |
| 4,838,017 | 6/1989 | Kolmes et al. | 57/210 |
| 4,912,781 | 4/1990 | Robins et al. | 2/167 |
| 5,177,948 | 1/1993 | Kolmes et al. | 57/229 |
| 5,248,548 | 9/1993 | Toon | 428/222 |
| 5,442,815 | 8/1995 | Cordova et al. | 2/161.7 |

FOREIGN PATENT DOCUMENTS

| | | | |
|---|---|---|---|
| 0445872A1 | 9/1991 | European Pat. Off. | D02G 3/12 |
| 2-292036 | 12/1990 | Japan | B32B 27/12 |
| 6-220730 | 8/1994 | Japan | D02G 3/04 |
| 6-280140 | 10/1994 | Japan | D04B 1/28 |
| 652438 | 4/1965 | South Africa . | |
| 1036722 | 7/1966 | United Kingdom . | |

*Primary Examiner*—Helen L. Pezzuto

[57] ABSTRACT

A fabric made using a para-aramid yarn is disclosed having increased cut resistance and maintained comfort wherein the yarn has low twist and the staple fibers in the yarn have high linear density.

9 Claims, No Drawings

CUT RESISTANT YARN AND FABRIC

A CROSS REFERENCE TO RELATED APPLICATION

This is a continuing application claiming the priority of U.S. patent application Ser. No. 08/770,190, filed Dec. 19, 1996, which was based on U.S. Provisional Application No. 60/009,718, filed Jan. 5, 1996.

BACKGROUND OF THE INVENTION

Fabrics used in cut resistant garments can be generally rather stiff and bulky due the perceived need for strong yarns with a high modulus. It has been especially true that cut resistant garments, such as gloves, aprons, and protective sleeves, have been made from stiff yarns which yield stiff and uncomfortable fabrics with a harsh hand; and that modification of the yarns to yield fabrics with increased cut resistance have yielded fabrics which were even stiffer and more uncomfortable. This invention relates to cut resistant woven and knitted fabrics which exhibit improved cut resistance while maintaining an equivalent or softer hand.

SUMMARY OF THE INVENTION

This invention relates to apparel of improved cut resistance made from yarn having a linear density of 150 to 5900 dtex (133 to 5315 denier) and a twist factor of less than 26, wherein the yarn includes para-aramid staple fibers having a linear density of 3 to 6 dtex (2.7 to 5.4 denier) and a length of 2.5 to 15.2 centimeters (1 to 6 inches).

The invention also relates to the yarn and to a cut resistant fabric having a weight of 135 to 1017 grams per square meter (4 to 30 ounces/square yard) and made from the yarn.

DETAILED DESCRIPTION

There has long been a tension in the field of protective garments, between comfort and effectiveness; and considerable effort has been expended to increase the effectiveness while maintaining the comfort. The present invention represents just such an improvement in the field of cut resistant apparel and fabrics. By use of this invention, it is now possible to increase the cut resistant effectiveness and maintain the comfort, of fabrics and protective garments, such as cut resistant gloves.

It has been discovered that protective garments made from spun yarns of para-aramid fibers are softer if made from yarns which have a low degree of twist. Moreover, it has been discovered that the cut resistance of the fabric of such garments is independent of the degree of twist imparted to the yarns in the fabric and that the cut resistance of the fabric is improved by increasing the linear density of the individual fibers used in the yarns.

By para-aramid fibers is meant fibers made from para-aramid polymers; and poly(p-phenylene terephthalamide) (PPD-T) is the preferred para-aramid polymer. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which do not adversely affect the properties of the para-aramid.

Additives can be used with the para-aramid in the fibers and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

Staple fibers for use in spinning yarns are generally of a particular length and of a particular linear density. For use in this invention, the fibers can have any length which is adequate for manufacture of spun yarns. Staple lengths of 2.5 to 15.2 centimeters (1 to 6 inches) can be used and lengths of 3.8 to 11.4 centimeters (1.5 to 4.5 inches) are preferred. Yarns made from fibers having staple lengths of less than 2.5 centimeters have been found to require excessively high levels of twist to maintain strength for processing; and yarns made from fibers having staple lengths of more than 15.2 centimeters are more difficult to make due to the tendency for long staple fibers to become entangled and broken resulting in short fibers. The staple fibers of this invention are generally made by cutting continuous filaments to certain predetermined lengths; but staple can be made by other means, such as by stretch-breaking; and yarns can be made from such fibers as well as from a variety or distribution of different staple fiber lengths.

Spun yarns are held together by means of a twist incorporated into the yarn while spinning. Crimped staple fibers are spun on a spinning machine to yield a yarn with a certain twist. The twist helps to entangle the fibers together to form the yarn. In the past, it has been the usual practice to use yarns with a high degree of twist for cut resistant fabrics in protective garments. It was generally believed that the high twist was necessary for providing a yarn of high strength; and that the high strength was necessary for good cut resistance. That high degree of twist causes the fibers to be rather tightly bundled in the yarn form and creates a rather hard yarn.

It has now been discovered that yarns of high twist are not necessary for effective protection; and, in fact, it has been learned that cut resistance is substantially independent of the degree of twist in yarns used for the manufacture of protective fabrics. The degree of twist is, however, very important as a factor in the softness or comfort of such fabrics. It has been discovered that fabrics made using yarns of low twist are much softer with a finer "hand" than fabrics made using highly twisted yarns. Moreover, it is believed that decreased twist results in increased fabric softness, without regard to the kind of yarn or the material from which it is made.

Twist in yarns is usually represented by a factor called "Twist Factor", which may, also, be --called twist multiplier. A higher twist factor indicates a higher degree of twist. Cut resistant fabrics in protective garments have, up to now, been made with yarns having a preferred twist factor of greater than about 28 $(\text{tex})^{1/2}$(turns/cm) and using staple fibers with a linear density less than or equal to 2.5 dtex. The twist factor (TF) of a yarn is a number denoting the twist of fibers in a yarn, taking into account the linear density of the yarn, and can be defined using any of several dimensional systems:

Tex System–TF=(turns/centimeter)(tex)$^{1/2}$

Cotton System–TF=(turns/inch)/(cotton count of yarn)$^{1/2}$

Metric Count System–TF=(turns/meter)/(metric count of yarn)$^{1/2}$

"Cotton Count" of a yarn is the number of skeins of the yarn 768 meters (840 yards) long to have a weight of 454 grams (one pound).

"Metric Count" of a yarn is the number of kilometers of the yarn to have a weight of one kilogram.

For the purposes herein, the Tex System Twist Factor using SI units of tex$^{1/2}$ turns/cm will be used.

In fabrics of this invention, it has been found that yarns with a twist factor of less than about 26 yield a soft fabric which can be fashioned into comfortable, yet cut resistant, gloves. While it is necessary to have some degree of twist in the yarns in order for the yarns to stay together, tests indicate that cut resistance is not affected by changes in yarn twist. That is, the additional strength provided to the yarn by the use of increased twist does not translate to improved cut resistance. It has been concluded that, as a practical matter, the yarns of this invention should have a twist factor of at least about 10. For a single spun yarn of 10 Cotton Count (equal to 590 dtex) a twist factor of about 10 translates to a twist of about 1.3 turns per centimeter. It is preferred that yarns of this invention have a twist factor of 15 to 22.

Yarns are made of staple fibers. It has been found that the yarns which are used in practice of this invention should have a yarn linear density of 150 to 5900 dtex, and preferably 550 to 4700 dtex. The yarns may be made up of single strands or plied using several strands and may be twisted together or not.

As to the linear density of individual staple fibers, it has been discovered that increased linear density in the staple results in increased cut resistance for the yarn. In the past, cut resistant protective garments have utilized yarns having individual staple fibers of about 2.5 dtex or less. While those yarns have been adequate for many uses, it is now known that the cut resistance of a fabric can be improved by increasing the linear density of the staple fibers used in the yarns thereof. Moreover, it is known that the comfort of such a fabric can be maintained by decreasing the twist in the yarns thereof. Thus, by use of this invention, a fabric can be made having improved cut resistance and comfort equivalent with that of known products. For example, fabrics of improved cut resistance can be made using yarn with a twist factor of less than 26 which includes para-aramid staple fibers having a linear density of 3 to 6 dtex. Such fabrics will deliver improved cut resistance from the increased fiber linear density and maintained comfort from the decreased yarn twist.

From the comfort point of view, it has been found that low twist yarns of this invention should be made using staple fibers having a linear density of 3 to 6 dtex; and, preferably from 4 to 5 dtex. Fibers of less than about 3 dtex may not yield the improved cut resistance of this invention. Fibers of more than about 6 dtex exhibit very good cut resistance; but are not aesthetically acceptable and may not yield fabrics with adequate comfort.

The yarns of this invention can be made by any appropriate spinning process among which can be mentioned, cotton/worsted/woolen ring and open end spinning.

The spun yarn of this invention, having low twist and high linear density can be made into highly cut resistant fabrics which have been knitted or woven or even laid in unidirectional conformations. Also, the spun yarn can be made directly into gloves and other apparel by knitting machines. The cut resistance is a function of the linear density of filaments in the yarn and not of the manner that the yarn is presented in a fabric.

TEST METHODS

Cut Resistance. The method used was the "Standard Test Method for Measuring Cut Resistance of Fabrics Used in Protective Clothing", proposed as an ASTM Standard (ASTM Subcommittee F23.20). In performance of the test, a cutting edge, under specified force, is drawn one time across a sample mounted on a mandrel. At several different forces, the distance drawn from initial contact to cut through is recorded and a graph is constructed of force as a function of distance to cut through. From the graph, the force is determined for cut through at a distance of 25 millimeters and is normalized to validate the consistency of the blade supply. The normalized force is reported as the cut resistance force.

The cutting edge is a stainless steel knife blade having a sharp edge 70 millimeters long. The blade supply is calibrated by using a load of 400 g on a neoprene calibration material at the beginning and end of the test. A new cutting edge is used for each cut test.

The sample is a rectangular piece of fabric cut 50×100 millimeters on the bias at 45 degrees from the warp and fill directions.

The mandrel is a rounded electroconductive bar with a radius of 38 millimeters and the sample is mounted thereto using double-face tape. The cutting edge is drawn across the fabric on the mandrel at a right angle with the longitudinal axis of the mandrel. Cut through is recorded when the cutting edge makes electrical contact with the mandrel.

EXAMPLES

Knitting gloves and fabrics to be tested. Para-aramid filament yarns of four different linear densities were crimped and cut to make staple for spinning test yarns for these examples. The filament yarns were poly(p-phenylene terephthalamide) yarns sold by E. I. du Pont de Nemours and Company under the tradename Kevlar® 29, and were made from filaments having linear densities of 1.67, 2.50, 4.67, and 6.67 dtex. The staple length was 11.4 centimeters.

Portions of each staple fiber were spun by a worsted system into yarns having a variety of twists. Two-ply yarns were spun having a linear density of 590 dtex (Cotton Count, 20/2) and twist factors as shown in Tables 1 and 2.

Sample gloves and sample fabrics were knitted on a Shima Seiki glove knitting machine using these yarns and 4- and 6-end set-ups. The 4-end set-up resulted in a knitted fabric and string knit glove with an averaged weight of 478 g/square meter (14.1 ounces/square yard); and the 6-end set-up resulted in a knitted fabric and glove with an averaged weight of 783 g/square meter (23.1 ounces/square yard).

Example 1

The gloves prepared above were subjected to cut resistance tests to yield information relating to the relationship between cut resistance and the fabric parameters of staple linear density and yarn twist factor. Results of those tests are set out in Tables 1 and 2, below, for the 6-end and 4-end fabrics, respectively.

TABLE 1

| Lin. Den. → Twist ↓ | 6-End Fabric 1.67 dtex | 2.50 dtex (Cut Resistance (KG-force)) | 4.67 dtex | 6.67 dtex |
|---|---|---|---|---|
| 14 | 1.4 | 1.6 | 1.8 | — |
| 17 | 1.3 | 1.6 | 1.7 | 1.8 |
| 19 | 1.4 | 1.5 | 1.6 | 1.8 |
| 22 | 1.3 | 1.4 | 1.6 | 1.7 |
| 24 | 1.3 | 1.5 | 1.9 | 2.3 |
| 26 | 1.3 | 1.4 | 1.8 | 1.8 |
| 29 | 1.4 | 1.5 | 1.9 | 2.0 |
| 31 | 1.3 | 1.4 | 1.7 | 1.8 |
| avg. | 1.3 | 1.5 | 1.8 | 1.9 |

TABLE 2

| Lin. Den. → Twist ↓ | 4-End Fabric 1.67 dtex | 2.50 dtex (Cut Resistance (KG-force)) | 4.67 dtex | 6.67 dtex |
|---|---|---|---|---|
| 14 | 1.0 | 1.1 | 1.2 | — |
| 17 | 1.0 | 1.1 | 1.5 | 1.6 |
| 19 | 1.1 | 1.2 | 1.4 | 1.5 |
| 22 | 1.1 | 1.2 | 1.4 | 1.5 |
| 24 | 0.9 | 1.2 | 1.4 | 1.6 |
| 26 | 1.0 | 1.0 | 1.6 | 1.5 |
| 29 | 1.0 | 1.2 | 1.5 | 1.6 |
| 31 | 1.2 | 1.1 | 1.4 | 1.5 |
| avg. | 1.0 | 1.1 | 1.4 | 1.5 |

The Cut Resistance data from this example show that cut resistance is a definite function of staple linear density and is relatively independent of twist. The cut resistance improves dramatically with increase in staple linear density and the increase is most dramatic at staple linear densities of greater than 2.5 dtex.

Example 2

The 6-end fabrics prepared above were subjected to a comfort test wherein the thirty one fabric samples were evaluated by feel to determine the "hand" of each sample. Ten persons were asked to feel each sample and rate the softness on a scale of 1–5 with 1 being harshest and 5 being softest. All of the ratings of the ten persons were averaged and are recorded in Table 3, below.

TABLE 3

| Lin. Den. → Twist ↓ | 1.67 dtex | 2.50 dtex (Comfort Rating (Average of ten)) | 4.67 dtex | 6.67 dtex |
|---|---|---|---|---|
| 14 | 4.4 | 4.4 | 3.2 | — |
| 17 | 4.2 | 4.4 | 3.1 | 2.9 |
| 19 | 4.2 | 4.0 | 3.0 | 2.5 |
| 22 | 3.6 | 3.5 | 2.5 | 2.1 |
| 24 | 3.5 | 3.5 | 2.2 | 2.5 |
| 26 | 3.3 | 3.2 | 2.0 | 1.3 |
| 29 | 3.0 | 2.4 | 2.0 | 1.8 |
| 31 | 2.8 | 2.0 | 1.4 | 1.4 |

The Comfort data from this example show that comfort is a direct function of the degree of yarn twist. The comfort improves dramatically as twist is reduced. As stated previously, fabrics usually used in commercially offered gloves have been made from yarns with staple linear density of less than about 2.5 dtex and a preferred twist factor of greater than 28. It is clear from Table 3 that such fabrics were comfort rated at 2 to 3 in these tests; and that fabrics of this invention made from yarns with staple linear density of 4.67 dtex and twist factors of less than 26 were rated at least as good. Comfort clearly increases with decrease in staple linear density and decrease in twist.

Examples 1 and 2, show that fabrics made from yarns having staple linear densities of greater than 2.5 dtex exhibit improved cut resistance and fabrics made from yarns of less than 6.67 dtex and having twist factors of less than 26 exhibit improved comfort. A combination of those results show that yarns with staple linear densities of 3 to 6 dtex and twist factors of less than 26 will result in fabrics having, both improved cut resistance and maintained comfort.

What is claimed is:

1. A fabric made from yarn having a linear density of 150 to 5900 dtex and a twist factor of less than 26 wherein the yarn includes para-aramid staple fibers having a linear density of 3 to 6 dtex and a length of 2.5 to 15.2 centimeters.

2. The fabric of claim 1 wherein the staple fibers in the yarn have a linear density of 4 to 5 dtex.

3. The fabric of claim 1 wherein the yarn has a twist factor of 15 to 22.

4. The fabric of claim 1 having a weight of 135 to 1017 grams per square meter.

5. The fabric of claim 1 wherein the yarn is woven.

6. The fabric of claim 1 wherein the yarn is knitted.

7. The fabric of claim 3 having a weight of 135 to 1017 grams per square meter.

8. The fabric of claim 7 wherein the yarn is woven.

9. The fabric of claim 7 wherein the yarn is knitted.

* * * * *